United States Patent [19]

Clarke

[11] Patent Number: 5,009,068

[45] Date of Patent: Apr. 23, 1991

[54] PNEUMATIC CYLINDER WITH POSITIONING, BRAKING, AND FEED RATE CONTROL

[76] Inventor: Douglas C. Clarke, 540 Marling Crescent, Paga hill, Great Britain

[21] Appl. No.: 372,054

[22] Filed: Jun. 27, 1989

[30] Foreign Application Priority Data

Jun. 29, 1988 [GB] United Kingdom ..... 8815449

[51] Int. Cl.[5] ..... F15B 7/00

[52] U.S. Cl. ..... 60/583; 60/591; 60/593; 92/9; 92/12; 92/13.1; 92/13.6; 92/65; 92/75

[58] Field of Search ..... 92/8, 9, 10, 11, 13, 92/13.1, 65, 85 B, 13.6, 75; 60/591, 593, 583

[56] References Cited

U.S. PATENT DOCUMENTS

| | | | |
|---|---|---|---|
| 2,596,471 | 5/1952 | Densmore et al. | 92/13.1 |
| 2,605,751 | 8/1952 | Perry et al. | 92/9 |
| 2,860,604 | 11/1958 | Morf | 91/170 R |
| 2,918,902 | 12/1959 | Robinson et al. | 92/13.1 |
| 2,976,845 | 3/1961 | Goldring | 60/593 X |
| 3,005,444 | 10/1961 | Steibel | 60/593 X |
| 3,190,077 | 6/1965 | Scholin | 92/8 |
| 3,426,530 | 2/1969 | Georgelin | 60/583 X |
| 3,866,727 | 2/1975 | Myers | 92/13.1 X |

FOREIGN PATENT DOCUMENTS

| | | | |
|---|---|---|---|
| 2608904 | 9/1977 | Fed. Rep. of Germany . | |
| 3030599 | 3/1982 | Fed. Rep. of Germany . | |
| 840511 | 6/1981 | U.S.S.R. | 92/13.1 |
| 1041810 | 9/1966 | United Kingdom . | |
| 1183521 | 3/1970 | United Kingdom . | |
| 1242128 | 8/1971 | United Kingdom . | |
| 1351806 | 5/1974 | United Kingdom . | |
| 2080419 | 2/1982 | United Kingdom . | |
| 2178109 | 2/1987 | United Kingdom . | |

OTHER PUBLICATIONS

"Variable Oil Volume Modulates Air Cylinder Strokes", *Hydraulics & Pneumatics*, vol. 39, No. 5, May 1986, By G. Crouch, pp. 45–47.

*Primary Examiner*—John T. Kwon
*Assistant Examiner*—John Ryznic

[57] ABSTRACT

A pneumatic piston/cylinder unit comprises primary and secondary pistons operable in first and second cylinder zones respectively. Each of the primary and secondary pistons divide its respective cylinder zone into two chambers, one of the chambers of the first cylinder zone being connected to one of the chambers of the second cylinder zone via a passageway which includes at least one control for the flow of hydraulic fluid therethrough. A tertiary piston is provided in the one chamber of the first cylinder zone and divides that chamber into two parts, one of which is between the primary and tertiary pistons. In use the passageway, the one chamber of the second cylinder zone and the other part of the one chamber of the first cylinder zone are filled with hydraulic fluid. Application of pneumatic pressure to the other chamber of the first cylinder zone causes the primary piston to be displaced until it abuts the tertiary piston whereupon movement of the primary piston may be arrested or controlled.

9 Claims, 2 Drawing Sheets

PNEUMATIC CYLINDER WITH POSITIONING, BRAKING, AND FEED RATE CONTROL

INTRODUCTION

This invention relates to pneumatic cylinders.

Pneumatic cylinders have a wide range of uses in automation and other control functions. It is known to provide a pneumatic cylinder with positioning capabilities, or with accurate braking, or with feed rate control. However, none of the known cylinders has all of these facilities.

SUMMARY OF THE INVENTION

Accordingly, the present invention seeks to provide a pneumatic piston/cylinder unit which is more versatile than those which are already known.

According to the present invention, there is provided a pneumatic piston/cylinder unit comprising primary and secondary pistons operable in first and second cylinder zones respectively, and each dividing its respective cylinder zone into two chambers, one of the chambers of the first cylinder zone being connected to one of the chambers of the second cylinder zone by a passageway which includes means for controlling the flow of hydraulic fluid therethrough, and a tertiary piston in said one chamber of the first cylinder zone and dividing said one chamber into two parts, one of which is between the primary and tertiary pistons, the arrangement being such that, in use, the passageway, said one chamber of the second cylinder zone and the other part of said one chamber of the first cylinder zone are filled with hydraulic fluid, and the application of pneumatic pressure to the other chamber of the first cylinder zone causes the primary piston to be freely displaced until it abuts the tertiary piston whereupon movement of the primary piston may be arrested or controlled.

If the control means in the passageway comprises a restricted orifice, and preferably one which is variable, to control the flow of hydraulic fluid through the passageway, the piston/cylinder unit may be arranged so that the primary piston can initially undergo rapid movement and subsequently a controlled rate of movement in one direction.

To provide a variable settable stop, the control means in the passageway may comprise a valve to close the passageway to flow when required.

If rapid movement of the primary piston is required over its full stroke in said one direction as an alternative to a controlled rate of movement over part of that stroke, then a by-pass passageway may be provided, the by-pass passageway including a valve to open and close the by-pass passageway as required.

Preferably, the said one part of said one chamber of the first cylinder zone is selectively connectable to a supply of compressed air or exhaust. Alternatively, the said one part of the one chamber of the first cylinder zone may contain a return spring.

The other chambers of the first and second cylinder zones may be air chambers, which have connections for admission and exhaustion of compressed air. It may also be appropriate to utilise such an arrangement with a single-acting unit, with spring return.

It is preferred that the primary and secondary cylinder zones be co-axial, to limit the overall length of the unit, but an end-to-end arrangement is feasible if required. The passageway, and the by-pass passageway if provided, may be incorporated in an end cap of the unit, so that the overall length of a co-axial type of unit is very little increased, and the overall bulk is less than that of a conventional piston/cylinder unit, with an add on damping or stop mechanism.

The invention will now be more particularly described, by way of example, with reference to the accompanying drawings.

DESCRIPTION OF THE PREFERRED EMBODIMENT

Figure 1:
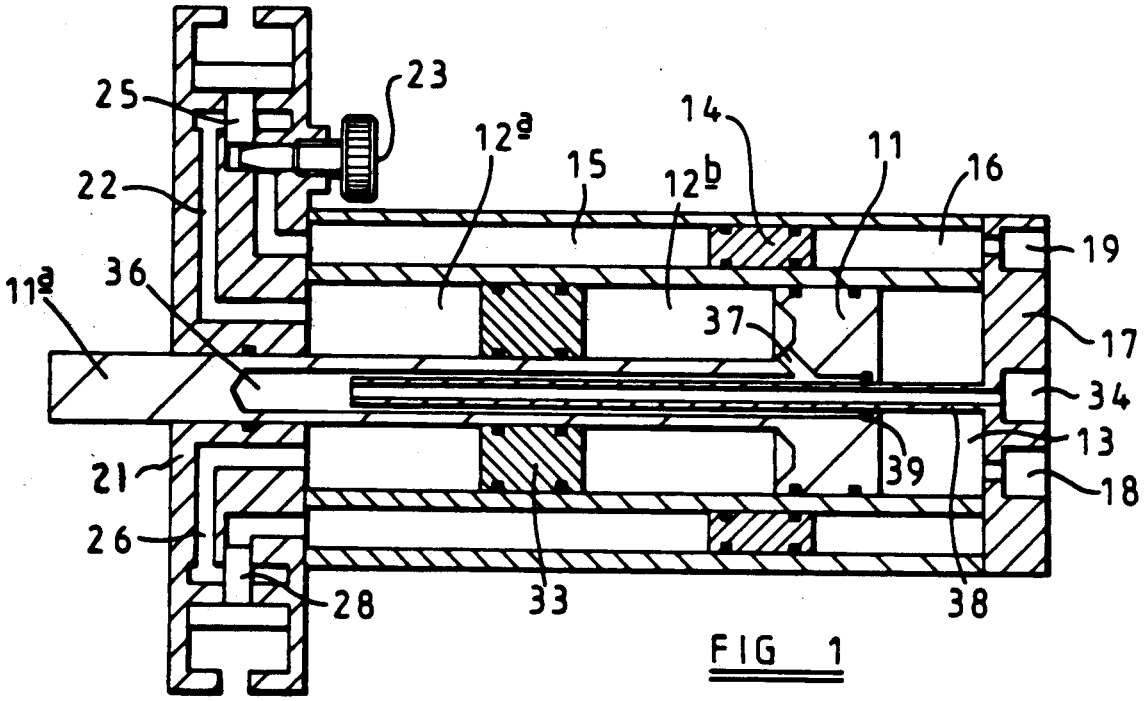
FIG. 1 is a sectional view of one embodiment of a unit according to the invention.

The piston/cylinder unit shown in the drawings comprises a primary piston 11 operating in a primary cylinder zone, which it divides into chambers 12 and 13. The primary piston 11 is attached to a piston rod 11*a* which is connected to the mechanism to be operated. A secondary piston 14 operates in a secondary cylinder zone which it divides into chambers 15 and 16. It will be seen that the cylinder zones are co-axial, to reduce the overall length of the unit, but it is not essential that they be so.

The chamber 12 is divided into two parts 12*a* and 12*b* by a tertiary piston 33, and the piston 33 is mounted on the piston rod 11*a* so that the piston rod 11*a* can move relative to the piston 33.

One end cap 17 of the unit has apertures 18 and 19 for unions to provide pressure/exhaust connections for the chambers 13 and 16 respectively. The end cap 17 also has an aperture 34 for a union to provide a pressure/exhaust connection to the part 12*b* of the chamber 12, the aperture 34 communicating with the part 12*b* of the chamber 12 through a tube 38, a hollow interior 36 of the piston rod 11*a*, and a drilling 37 in the piston 11. The tube 38 is secured to or is formed integrally with the end cap 17 and extends from the aperture 34 into the hollow interior 36 of the piston rod 11*a* through a seal 39.

The other end cap 21 includes a passageway 22 interconnecting the part 12*a* of the chamber 12 and the chamber 15. A flow control valve 23, shown as a manually operated needle valve, is provided in the passageway 22 to provide a variable restriction to the flow of hydraulic fluid through the passageway 22. A shut off valve 25, also shown as a manually operated needle valve, is also provided in the passageway 22 to block the passageway 22 completely.

The end cap 21 also includes a by-pass passageway 26 to by-pass the restriction provided by the valve 23. The by-pass passageway 26 is closable by a further shut off valve 28, which is also shown as a manually operated needle valve.

The valves 23, 25 and 28 need not be manually operated, but could be mechanically, pneumatically, hydraulically or electrically operated.

The part 12*a* of the chamber 12, the passageway 22, and the chamber 15 are filled with hydraulic fluid.

Figure 2:
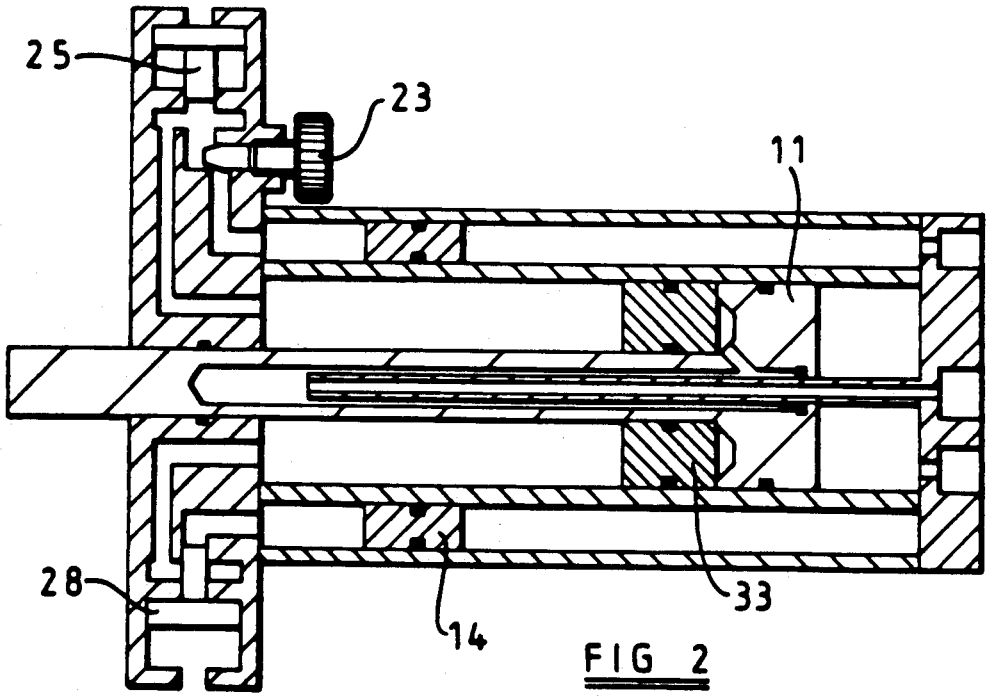
FIGS. 2 to 4 show the unit of FIG. 1 in various different states of operation.
Figure 3:
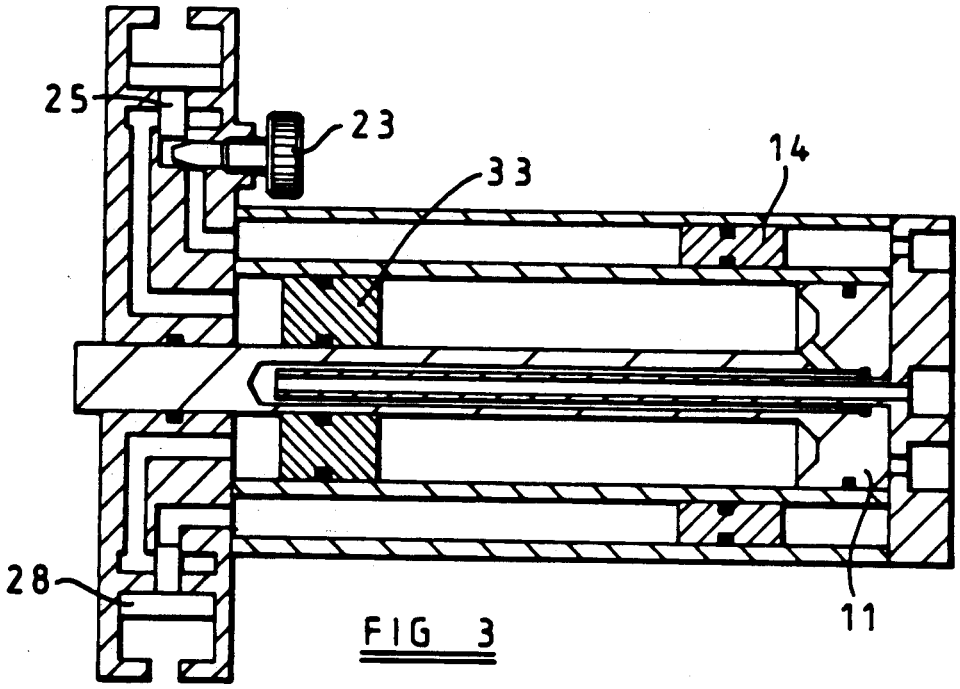

In operation, with the primary piston 11 at the right hand end of the chamber 13 and the secondary and tertiary pistons 14 and 33 in the positions shown in FIG. 2, and with the valve 25 open and the valve 28 closed, compressed air is admitted into the chamber 13 through the aperture 18, and apertures 19 and 34 are connected to exhaust. The piston 11 and its associated piston rod 11*a* move rapidly to the left. When the piston 11 abuts the piston 33, hydraulic fluid is displaced through the passageway 22 and past the valve 23 and into the chamber 15 to displace the piston 14 to the right as far as it will go or until valve 25 is closed. Thus, it will be seen that the variable restriction provided by the valve 23 controls the flow of hydraulic fluid, and hence the rate of displacement of the piston 11 and the piston rod 11*a* after the piston 11 abuts the piston 33. The piston rod 11*a* therefore advances rapidly at first and then at a controlled rate. The reverse operation is obtained by applying pneumatic pressure at aperture 19, while connecting apertures 18 and 34 to exhaust. Piston 14 is moved to the left towards a position shown in Figure displacing hydraulic fluid through the passageway 22 past the valve 23. The hydraulic fluid in turn displaces the piston 33 which in turn displaces the piston 11 and the piston rod 11*a* back towards the positions shown in FIG. 1, at a rate controlled by the restriction provided by the valve 23. Movement of the piston 33 may be arrested at, for example, the position shown in FIG. 3, or at any other position, by closure of the valve 25. The primary piston 11 may then be returned to its starting position by applying pressure to the connection 34 and connecting aperture 18 to exhaust.

Figure 4:
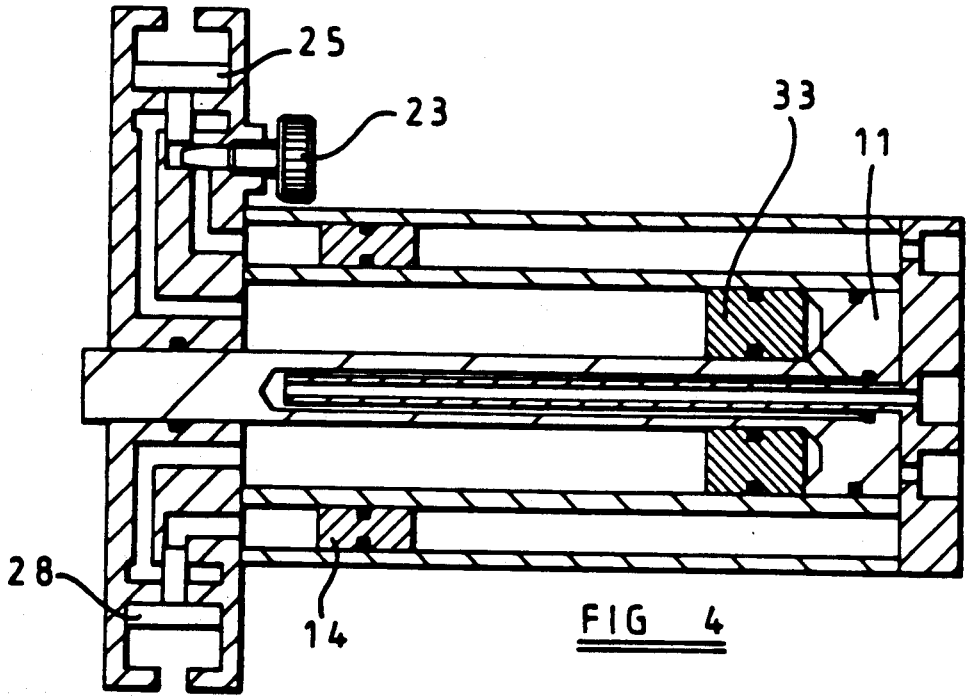

If no initial rapid advance of the piston 11 is required, the tertiary piston 33 is moved fully to the right (as shown in FIG. 4) and the part 12*b* of the chamber 12 is kept collapsed by connection to exhaust, so that the pistons 11 and 33 operate in unison.

If rapid advance of the piston 11 throughout its entire stroke is required, then the valve 28 is opened to open the by-pass passageway 26.

If a hydraulic stop is required, valves 25 and 28 are both closed so that when the primary piston 11 abuts the tertiary piston 33, movement of the primary piston 11 will be arrested. If the piston/cylinder unit is used in this mode of operation, the position of the tertiary piston 33 can be varied with one or other of valves 25 and 28 open, by applying pneumatic pressure at aperture 34 with aperture 19 connected to exhaust, or by applying pneumatic pressure at aperture 19 with aperture 34 connected to exhaust.

The piston/cylinder unit described above is extremely versatile and, as will be appreciated, can be operated in various different modes.

Various modifications may be made within the scope of the invention. For example, instead of applying pneumatic pressure to obtain reverse movement, the units may be single acting, with return springs incorporated, either in the unit itself, or in the mechanism to be operated.

What I claim is:

1. A pneumatic piston/cylinder unit comprising primary and secondary pistons operable in first and second cylinder zones respectively, and each dividing its respective cylinder zone into two chambers, one of the chambers of the first cylinder zone being connected to one of the chambers of the second cylinder zone by a passageway which includes means for controlling the flow of hydraulic fluid therethrough, and a tertiary piston in said one chamber of the first cylinder zone and dividing said one chamber into two parts, one of which is between the primary and tertiary pistons, the arrangement being such that, in use, the passageway, said one chamber of the second cylinder zone and the other part of said one chamber of the first cylinder zone are filled with hydraulic fluid, and the application of pneumatic pressure to the other chamber of the first cylinder zone causes the primary piston to be freely displaced until it abuts the tertiary piston whereupon movement of the primary piston may be arrested or controlled.

2. A pneumatic piston/cylinder unit as claimed in claim 1, wherein the control means in the passageway comprises a restricted orifice to control the rate of movement of the primary piston after it abuts the tertiary piston.

3. A pneumatic piston/cylinder unit as claimed in claim 2, wherein the restricted orifice is a variable restricted orifice.

4. A pneumatic piston/cylinder unit as claimed in claim 1, wherein the control means in the passageway comprises a valve to close the passageway to flow so as to arrest the primary piston when it abuts the tertiary piston.

5. A pneumatic piston/cylinder unit as claimed in claim 1, wherein a by-pass passageway is provided between said one chamber of the first cylinder zone and said one chamber of the second cylinder zone, the by-pass passageway including a valve to open and close the by-pass passageway as required.

6. A pneumatic piston/cylinder unit as claimed in claim 1, wherein the said one part of said one chamber of the first cylinder zone is selectively connectable to a supply of compressed air or exhaust.

7. A pneumatic piston/cylinder unit as claimed in claim 1, wherein the other chambers of the first and second cylinder zones are air chambers and have connections for admission and exhaustion of compressed air.

8. A pneumatic piston/cylinder unit as claimed in claim 1, wherein the first and second cylinder zones are co-axial.

9. A pneumatic piston/cylinder unit as claimed in claim 8, wherein the passageway, and the by-pass passageway if provided, are incorporated in an end cap of the unit.

* * * * *